US006724858B2

(12) United States Patent
Holz

(10) Patent No.: US 6,724,858 B2
(45) Date of Patent: Apr. 20, 2004

(54) X-RAY OPTICAL SYSTEM

(75) Inventor: Thomas Holz, Dresden (DE)

(73) Assignee: Fraunhofer-Gesellschaft zur Forderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 10/048,873

(22) PCT Filed: May 18, 2001

(86) PCT No.: PCT/DE01/02043

§ 371 (c)(1),
(2), (4) Date: Mar. 13, 2002

(87) PCT Pub. No.: WO01/94987

PCT Pub. Date: Dec. 13, 2001

(65) Prior Publication Data

US 2002/0159562 A1 Oct. 31, 2002

(30) Foreign Application Priority Data

Jun. 5, 2000 (DE) ..... 100 28 970

(51) Int. Cl.[7] ..... G21K 1/26
(52) U.S. Cl. ..... 378/85; 378/84
(58) Field of Search ..... 378/85, 84, 70, 378/71, 43, 73

(56) References Cited

U.S. PATENT DOCUMENTS 4,684,565 A * 8/1987 Abeles et al. ..... 428/220
5,239,566 A * 8/1993 Nakamura et al. ..... 378/43
5,461,657 A 10/1995 Hayashida et al.
5,551,587 A * 9/1996 Keppel et al. ..... 216/24
5,911,858 A * 6/1999 Ruffner ..... 204/192.27
6,049,588 A 4/2000 Cash, Jr.
6,160,867 A * 12/2000 Murakami ..... 378/84
6,295,164 B1 * 9/2001 Murakami et al. ..... 359/584

FOREIGN PATENT DOCUMENTS

DE 44 43 853 A1 6/1996
EP 0 340 097 11/1989
JP 08146199 A * 6/1996 ..... G21K/5/02
WO WO 99/43009 8/1999

OTHER PUBLICATIONS

Erko, A. et al., "X–ray supermirrors for BESSY II", Rev. Sci. Istrum., vol. 66, No. 10, Oct. 1995, pp. 4845–4846.
Eichler, Hans–Joachim et al., Lehrbuch Der Experimental Physik Band III Optik, Herausgegeben von Heinrich Gobrecht, Editor; Walter De Gruyter, Pub, 7$^{th}$ Ed. Berlin—New York 1978, p. 14.

* cited by examiner

*Primary Examiner*—Craig E Church
*Assistant Examiner*—Irakli Kiknadze
(74) *Attorney, Agent, or Firm*—Barnes & Thornburg

(57) ABSTRACT

An X-ray optical system with an X-ray source, an element that focuses the X-rays and an element that reflects them. In order to generate parallel X-radiation with small beam cross-section and high photon density, the X-radiation of the X-ray source is directed with its focusing element to the convex, parabolic and reflecting surface of the reflecting element. The X-ray optical system is useful for X-ray analysis, e.g., in X-ray diffractometry, reflectometry and/or fluorescence analysis.

10 Claims, 2 Drawing Sheets

X-RAY OPTICAL SYSTEM

CROSS-REFERENCE TO RELATED APPLICATIONS

Figure 1:
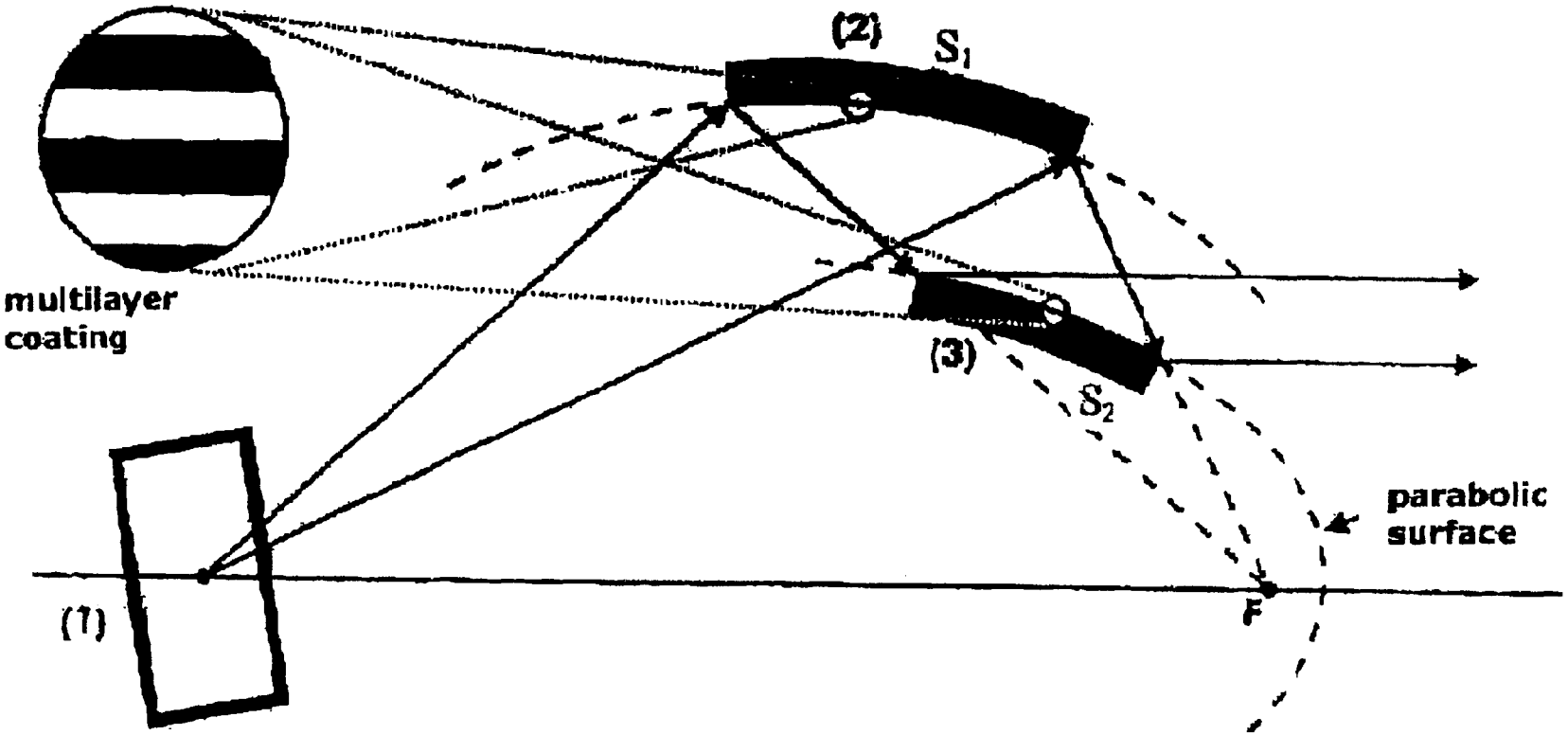

This application is a U.S. national counterpart application of international application serial No. PCT/DE01/02043 filed May 18, 2001, which claims priority to German application serial no. 100 28 970.3 filed Jun. 5, 2000.

The invention relates to an X-ray optics arrangement according to the preamble of claim 1. It may be particularly advantageously employed in the X-ray analysis, e.g. with the X-ray diffraction measurement, reflectometry and/or fluoro-chemical analysis.

In the X-ray analysis, the most various applications require X-radiation having a high intensity, i.e. in particular a high photon flux density. This can be achieved by focussing X-ray beams. However, in many cases it is more favourably to allow X-radiation having a very small divergence to be employed as a parallel X-radiation in the best case.

In the X-ray analysis it may also be required to provide the X-radiation in a monochromatic manner, however, in order to be able carrying out particular analyses.

Moreover, in the X-ray analysis it is desired to achieve a high surface sensitivity of the X-radiation with respect to surfaces to be analyzed or in fluidic samples which are present on substrate carriers. In such cases the X-radiation is preferably directed in a grazing manner, i.e. with relatively small angles of incidence up to a maximum of few degrees of angles of incidence and few tenth of degrees of angles of incidence, respectively, i.e. in the proximity of the critical angle of total reflection upon a sample surface and an appropriate substrate surface, respectively, and consequently the radiation cross section of the radiation is projected upon the sample surface according to $1/\sin\theta$. It is desired to further increase the photon flux density per surface on the projection surface and to concentrate toward a smaller projection surface, respectively. The surface intensity and therefore the photon flux density as well are allowed to be increased by great focussing of parallel and approximately parallel X-ray beams as being well known, and consequently each locally detectable measuring signal of a sample can also be increased. In particular, the spatial resolution of the measuring signals, i.e. the greatest possible accurate coordination of the measuring signals to the measuring point provides high requirements with respect to the measuring set-up.

Usually, appropriately small dimensioned shutters are arranged in the beam path of the X-radiation such that only one portion of the X-radiation is allowed to pass through the shutter aperture towards the measuring point, and thus a locally defined coordination of the measuring signal with respect to the measuring point will be achieved. Of course, the use of such shutters causes intensity losses of the X-radiation which cannot be used for the measurement. The measuring accuracy suffers therefrom, and an increase of the required measuring time has to be accepted, respectively, which is not desired for many cases of application and also makes measurements impossible, respectively.

The mentioned drawbacks could not be completely eliminated with X-ray optics structures as well in which multilayer systems having period thicknesses adapted to concave curvatures are used which are described in DE 44 43 853 A1, for example, and it did not succeed in reducing the beam cross section of the X-radiation so far such that the intensity fall-offs due to the required shutters occur admittedly in a decreased form as always.

Miniaturizing greatly proceeds in particular in the semiconductor technology, and the step from the microrange into the nanorange requires ways from the analytics to allow the particular elements and compounds to be analyzed with a high measuring accuracy simultaneously with high spatial resolution in a short period.

Therefore, it is an object of the invention to provide an X-ray optics arrangement by means of which parallel, however, at least approximately parallel X-radiation having small beam cross sections and a respective high photon flux density can be provided.

According to the invention this object is solved with the features of claim 1. Advantageous embodiments and improvements of the invention can be achieved with the features indicated in the subordinate claims.

In the X-ray optics arrangement according to the invention usual X-ray optics components are used such as a suitable X-ray source, an X-ray focussing element and an X-ray reflecting element. Then, the X-radiation of the X-ray source is directed upon the focussing element wherein it can be a matter of an element achieving a lens effect, however, more favourably of an respective shaped reflector. The X-radiation foccussed by this element is directed upon an X-radiation reflecting element which reflecting surface is formed in a convex and parabolic manner.

Because of this surface form of the reflecting element the focussing (compression) of the X-radiation and its parallel alignment having a neglectable divergence is allowed to be simultaneously obtained which can be directed upon appropriately arranged and aligned surfaces of a sample and a substrate, respectively.

Depending on the form of the focussing element the convergent X-radiation can be generated with punctual, elliptical or line shaped cross sections wherein the surface contour of the element reflecting the X-radiation as well is adapted to this geometry, of course. With respect to line shaped beam cross sections the focussing and the reflecting elements are allowed to have a cylindrical symmetry.

For many cases of application the function of the employed shutter changes, and it serves to suppress diffused light. If shutters are required in the individual case as always in order to increase the spatial resolution, however, a substantially smaller portion of the X-ray intensity will be shuttered out by the shutters since the photon flux density in the appropriately compressed X-radiation is considerably higher than being the case with well-known solutions. Thus, an intensity gain which is greater than 2 can be achieved.

At least the surface of the reflecting element is allowed to comprise an individual reflecting layer, however, or a multilayer system which is more favourably in many cases.

If one individual reflecting layer or a reflecting element is merely used which consists of an appropriately suitable material, the X-radiation from the focussing element can be directed upon the reflecting element with an angle of $\leqq$than the critical angle $\Theta_C$ of the total reflection, and the desired effect can be achieved.

In many cases, it is more favourably to use a gradient multilayer system, however, in which considering the different angles of incidence of X-rays, the individual layers of the multilayer system comprise an appropriately adapted thickness distribution by means of which the respective angles of incidence $\Theta_i$ with a predeterminable wavelength of X-radiation meet the BRAGG relationship on each surface element of the reflecting element. The gradient layers comprise a double layer thickness varying over the length.

As a result, a further increase of the photon flux density and also an improved monochromaticity of the X-radiation can be achieved. The adjacent individual layers of each multilayer system comprise different X-ray optics refractive indices.

A greatest possible high compression of X-radiation can be achieved when the focal points F of the focussing and reflecting elements coincide with each other, however, and are arranged at least in the proximity to each other.

When the focussing element images the X-ray source into a line focus, it is further advantageous to select the parabolic form of the reflecting element to be cylindrically symmetric in order to achieve a line shaped parallel radiation.

In addition to the already mentioned advantages with the X-ray optics arrangement according to the invention a higher spatial resolution of the measuring signals can be achieved also at small angles of incidence of X-radiation since the projection surface on the sample will be reduced with approximately the same photon number.

Generally, with the invention the signal-to-noise ratio can also be improved since an additional monochromator is located in the beam path with the reflecting element.

In addition to the shortening of the measuring time the dynamic range of the measurement can be increased as well which e.g. allows to rise the information content of a measured oscilloscope pattern since diffraction orders eventually covered by background signals can be detected.

By means of a translational motion and/or a horizontal-swing about particular distances and angles of the focussing and/or reflecting elements the X-radiation can be directed upon defined small measuring points/measuring surfaces.

Figure 2:
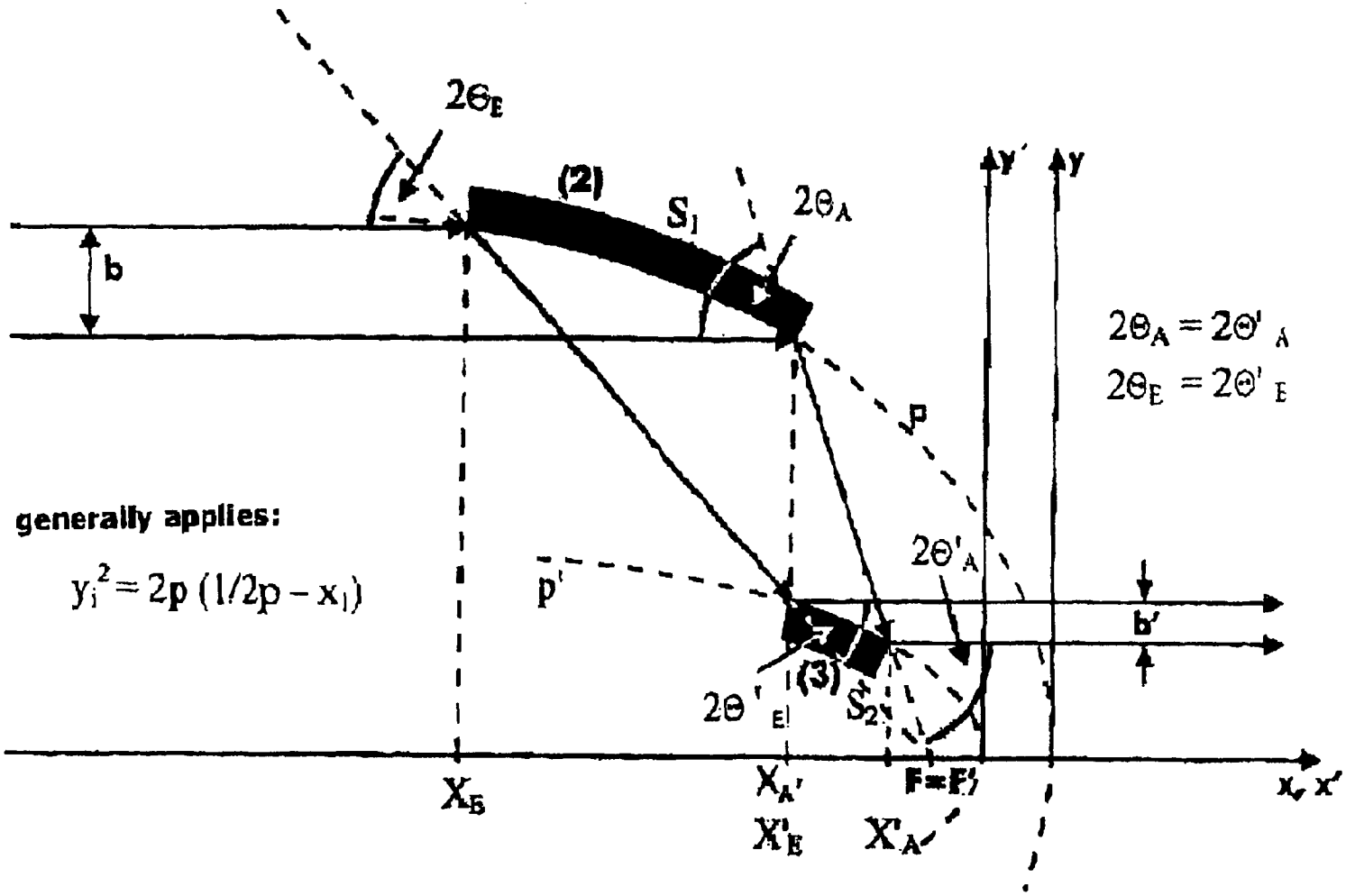

In the following the invention shall be explained according to an embodiment in which:

FIG. 1 diagrammatically shows an embodiment of an X-ray optics arrangement according to the invention in which divergent X-radiation of an X-ray source is directed upon a focussing element and converted into parallel radiation having a smaller beam cross section; and FIG. 2 shows in a diagrammatic form an embodiment of an arrangement in which parallel X-radiation is directed upon a focussing element and converted into parallel radiation having a clearly smaller beam cross section.

With respect to the embodiment illustrated in FIG. 1 divergent X-radiation of an X-ray source 1 is directed upon a concave surface formed as an elliptical or parabolic form having a reflecting surface for the X-radiation used which is a multilayer system in this case. The X-radiation is reflected therefrom and continuously directed upon the convex parabolic reflecting surface of the reflecting element wherein the X-radiation reflected from the reflecting element 3 is simultaneously compressed and aligned in parallel. The parallel X-radiation thus focussed then can be employed for the different methods of X-ray analysis in which cross sections of X-radiation being in the range of smaller than 200 $\mu$m are readily achievable.

On the reflecting surface of the reflecting element 3 a multilayer system can also be available in which the layer thicknesses of the individual layers are locally taken into consideration in accordance with the different angles of incidence of the X-radiation. In this case the parallel reflected X-radiation is not only allowed to comprise a higher intensity but additionally it will also be provided in a monochromatic manner.

With the embodiment of an arrangement according to the invention illustrated in FIG. 2 X-radiation having a smaller divergence and without divergence, respectively, is directed in a parallel form upon the concave, parabolic reflecting surface of a focussing element 2. The X-radiation is appropriately reflected from this surface and is simultaneously focussed and directed upon the surface of the reflecting element 3. From the illustration it is clearly recognizable that the beam cross section b of the X-radiation reflected in parallel from the reflecting element 3 is considerably smaller than the beam cross section b of the originally employed parallel X-radiation. Therefrom it results that with a sufficiently high reflectivity of (2) and (3) the photon flux density in the X-radiation reflected from the reflecting element 3 has been increased compared with the original parallel radiation.

Advantageously, the reflecting element is again provided with a multilayer system on the reflecting surface wherein the period thickness d of the individual layers meet the BRAGG relationship $\lambda=2d_{eff}\sin\Theta$ ($d_{eff}$ being the effective period thickness considering the dispersion).

Since the focussed X-radiation predetermines different angles of incidence $\Theta_i$ upon the reflecting surface of the reflecting element 3, consequently it is also required to employ an appropriate gradient multilayer system which comprises a different period thickness $d_i$ depending on the respective angles of incidence with the appropriate wavelength of X-radiation.

Ways of forming such a multilayer system are mentioned in the unpublished document DE 199 32 275 on which disclosure on this matter shall be fallen back in a complete scope.

Both in the FIG. 1 and FIG. 2 it is illustrated that the respective reflecting surfaces of the focussing element 2 and the reflecting element 3 are formed and the two elements 2 and 3 are arranged to each other such that their focal points F coincide with each other.

In the embodiments according to the FIG. 1 and FIG. 2 the reflecting surface of the focussing element 2 has a parabolic form (FIG. 2) however, it is allowed to employ an elliptical contour (FIG. 1) as well.

In the embodiment according to the FIG. 2 in which parallel and almost parallel output X-radiation, respectively, is used, assuming that $X_A$, $X_E$ >> p/2, in particular the equation applies:

$$\frac{b}{b'}=\frac{Y_E-Y_A}{Y'_E-Y'_A}=\frac{\sqrt{2px_E}-\sqrt{2px_A}}{\sqrt{2p'x'_E}-\sqrt{2p'x'_A}} \tag{1}$$

wherein the parabolic equations $$Y=\sqrt{2px}$$

and $$Y'=\sqrt{2p'x}$$

respectively, have been based.

Using the ray equation and the parabolic equation this can be simplified as $$\frac{b}{b'}=\frac{p}{p'} \tag{2}$$

wherein p and p' are the respective parabolic parameters of the focussing element 2 and the reflecting element 3.

It follows therefrom that an increase of the photon flux density can be achieved every time that the ratio of the beam cross sections multiplied by the product of the mean reflectivities of the focussing element 2 R(2) and reflecting element 3 R(3) becomes R(2)*R(3)*b/b'>1.

What is claimed is:

1. An X-ray optics arrangement comprising an X-ray source, one element focusing X-rays and one element reflecting X-rays for the generation of a parallel X-radiation having a small beam cross section of high photon flux density, wherein said X-radiation of said X-ray source is directed with said focusing element upon a convex, parabolic and reflecting surface of the reflecting element, and wherein a multilayer system is provided on the surface of said reflecting element, the multilayer system including multiple layers, individual ones of which multiple layers are gradient layers, said X-radiation being directed upon said reflecting element with an angle≦critical angle $\Theta_c$ of the total reflection.

2. The X-ray optics arrangement according to claim 1 wherein the focal points F of said focusing element and said reflecting element coincide.

3. The X-ray optics arrangement according to claim 1 wherein said focusing element has a concave, parabolic or elliptical surface.

4. The X-ray optics arrangement according to claim 1 wherein said parabolic surface of said reflecting element is cylindrically symmetric.

5. The X-ray optics arrangement according to claim 1 wherein adjacent individual layers of each multilayer system comprise different X-ray optical refractive indices.

6. An X-ray optics arrangement comprising an X-ray source, one element focusing X-rays and one element reflecting X-rays for the generation of a parallel X-radiation having a small beam cross section of high photon flux density, wherein said X-radiation of said X-ray source is directed with said focusing element upon a convex, parabolic and reflecting surface of the reflecting element, and wherein a multilayer system is provided on the surface of said reflecting element, the multilayer system including multiple layers, individual ones of which multiple layers are gradient layers, said X-radiation having angles of incidence Θi being directed upon said multilayer system having gradient layers such that with a predeterminable wavelength of X-radiation the BRAGG relationship is met on each surface element of the reflecting element.

7. The X-ray optics arrangement according to claim 6 wherein the focal points F of said focusing element and said reflecting element coincide.

8. The X-ray optics arrangement according to claim 6 wherein said focusing element has a concave, parabolic or elliptical surface.

9. The X-ray optics arrangement according to claim 6 wherein said parabolic surface of said reflecting element is cylindrically symmetric.

10. The X-ray optics arrangement according to claim 6 wherein adjacent individual layers of each multilayer system comprise different X-ray optical refractive indices.

* * * * *